US005478181A

United States Patent [19]

Rudolf, III et al.

[11] Patent Number: 5,478,181

[45] Date of Patent: Dec. 26, 1995

[54] METHOD AND APPARATUS FOR MOVING CONTAINERS BETWEEN A SHIP AND A DOCK

[75] Inventors: C. Davis Rudolf, III; Anthony P. Simkus, Jr., both of Virginia Beach, Va.

[73] Assignee: Virginia International Terminals, Inc., Norfolk, Va.

[21] Appl. No.: 186,511

[22] Filed: Jan. 26, 1994

Related U.S. Application Data

[63] Continuation-in-part of Ser. No. 8,953, Jan. 26, 1993, abandoned.

[51] Int. Cl.[6] ..... B63B 27/12

[52] U.S. Cl. ..... 414/140.3; 414/141.3; 212/273; 212/199; 212/319

[58] Field of Search ..... 212/146, 147, 212/213, 190, 192, 199; 414/917, 139.6, 139.7, 140.3, 141.3, 141.4, 141.7

[56] References Cited

U.S. PATENT DOCUMENTS

| | | | |
|---|---|---|---|
| 1,192,016 | 7/1916 | Stuart . | |
| 1,373,464 | 4/1921 | Titcomb . | |
| 2,050,821 | 8/1936 | Vercoe . | |
| 3,102,642 | 9/1963 | Zweifel . | |
| 3,168,955 | 2/1965 | Black . | |
| 3,471,040 | 10/1969 | Field . | |
| 3,543,952 | 12/1970 | Young . | |
| 3,812,987 | 5/1974 | Watatani . | |
| 3,881,608 | 5/1975 | Hupkes . | |
| 3,958,106 | 5/1976 | Bedford et al. . | |
| 4,046,265 | 9/1977 | Wormmeester et al. . | |
| 4,049,132 | 9/1977 | Stromback . | |
| 4,106,639 | 8/1978 | Montgomery et al. . | |
| 4,172,685 | 10/1979 | Nabeshima et al. . | |
| 4,279,347 | 7/1981 | Appleman . | |
| 4,293,077 | 10/1981 | Makino . | |
| 4,599,027 | 7/1986 | Knapp . | |
| 4,747,745 | 5/1988 | Pippen et al. | 212/147 |
| 4,753,357 | 6/1988 | Miyoshi et al. . | |
| 4,990,046 | 2/1991 | Tax et al. . | |
| 5,048,703 | 9/1991 | Tax et al. . | |

FOREIGN PATENT DOCUMENTS

| | | | |
|---|---|---|---|
| 2265664 | 11/1975 | France | 212/147 |
| 1756411 | 4/1970 | Germany | 212/146 |
| 51650 | 4/1977 | Japan | 212/147 |
| 27945 | 3/1978 | Japan | 212/147 |
| 62-126040 | 6/1987 | Japan . | |
| 502830 | 9/1976 | U.S.S.R. | 212/147 |
| 994391 | 2/1983 | U.S.S.R. | 212/146 |

*Primary Examiner*—Michael S. Huppert
*Assistant Examiner*—Gregory A. Morse
*Attorney, Agent, or Firm*—Popham, Haik, Schnobrich & Kaufman, Ltd.

[57] ABSTRACT

The present invention relates to a dockside crane for moving cargo between a dock and a water-borne vessel. The crane has an elongated girder extending horizontally over the dock and the vessel. The crane can vertically raise and lower the girder to change its elevation, so as to minimize distance and time travel for the cargo. A trolley moves horizontally on the girder, and has a cargo engaging device which is lowered to and raised from cargo locations on the dock and vessel. The cargo engaging device can be raised sufficiently adjacent to the trolley, and may be held tightly thereagainst, to permit large horizontal accelerations and velocities with virtually no attendant sway of the trolley or cargo. Preferably, paddles extend downwardly from the trolley to beneath the center of gravity of the cargo, to further ensure no sway is encountered. Advantageously, an operator cab is provided which moves independently of the trolley, so that the operator can view the load from a variety of angles throughout the cargo moving process.

14 Claims, 7 Drawing Sheets

METHOD AND APPARATUS FOR MOVING CONTAINERS BETWEEN A SHIP AND A DOCK

CROSS-REFERENCE TO RELATED APPLICATION

This is a continuation-in-part (CIP) of U.S. patent application Ser. No. 08/008,953, filed Jan. 26, 1993, now abandoned, which is incorporated herein by reference in its entirety.

BACKGROUND OF THE INVENTION

1. Field of the Invention

The present invention relates to apparatus and methods for transporting a load between various locations. In particular, the invention is concerned with improvements in the construction and operation of a crane for transferring cargo containers between a dock and a ship.

2. Related Art

During the past several decades major changes have occurred in the handling of seagoing cargo between ships and the dock. The most noteworthy development has been the evolution and utilization of container ships and container cranes. Container ships allow the handling of cargo packed in standardized rectangular containers which allow their systematic movement by appropriately configured equipment from location to location and the stacking of these containers for storage and further handling. A container crane is a large, dockside, gantry crane that can move lengthwise on railroad rails along the dock. This type of crane typically has a large, horizontal trolley beam or girder which is vertically and permanently fixed at some particular elevation and extends over a ship moored alongside a dock. Along this trolley girder is a moveable carriage or trolley which rides on the beam. Wire ropes on the trolley suspend a lift beam, also known as a spreader, which is designed to engage the corners of a cargo container by a device called a twist lock. One twist lock type of mechanism is described in a Loomis et al. U.S. Pat. No. 3,749,438. The trolley is operable along the trolley girder, part of which is called a boom if it can be pivotally raised or lowered about a hinge point, for carrying a cargo container through the entire horizontal distance between the dock and the ship. Vertical hoisting or lowering of a container by the trolley along this horizontal path is also possible which allows clearance of any obstacles in the path.

This typical single hoisting trolley container crane has several shortcomings, among which is the fact that the permanently fixed trolley girder must be located high enough to be able to work above many different sizes of vessels. Because the girder must be positioned and fixed at such a high elevation, there is an increase in operator parallax and in the distance to where the spreader is to be positioned for attachment to a container. Although this type of single hoist crane can be designed for horizontal trolley travel at increasingly higher speeds in an attempt to realize better operating cycle times, the fact that the container load is usually suspended some distance below the trolley by wires creates undesirable sway characteristics which oppose a decrease in the overall cycle time.

In recognizing the limitations of single hoist cranes, other prior art proposals have included the utilization of a dual hoist type of crane which breaks the operating cycle into two separate phases in a manner very similar to what is known by fire fighters as a bucket brigade. A bucket brigade allows the faster passing of pails of water from person to person, as opposed to persons running individually from the source of the water to the fire site. Examples of dockside container cranes using dual hoist principles are described in the following U.S. Pat. Nos. 3,812,987 (Watatani); 4,046,265 (Wormmeester et al.); 4,106,639 (Montgomery et al.); 4,172,685 (Nabeshima et al.); 4,293,077 (Makimo); and 4,599,027 (Knapp).

These patents describe various types of cranes, some utilizing a stationery intermediate platform with a second hoisting trolley, others using elevating intermediate platforms. Although a higher productivity can be realized through the utilization of an intermediate platform, such breaking of the cycle into two parts complicates the equipment and makes it considerably more expensive. The fact that two operators are also required to operate a dual hoist crane additionally and significantly raises the operating cost of the equipment.

SUMMARY OF THE INVENTION

Accordingly, it is an object of the present invention to provide a dockside crane having a horizontal trolley girder extending over the dock and a moored vessel that can be raised or lowered for allowing the trolley girder to be positioned at any number of elevations between its lower and upper extreme positions, with a trolley operable along this girder and having a spreader to lift cargo from and set cargo on the dock and the ship.

Another object of the invention resides in the improvement whereby the trolley girder is placed as close to the operating level on the ship as safety and clearance permit so that a load, when moved to or from the ship, can be quickly raised by the spreader which is held tightly against the trolley in order that the trolley and load can be moved at high accelerations and speeds along the length of the girder without sway.

A further object of the present invention is to minimize vertical hoist distance in a dockside crane through the lowering of the trolley girder to the lowest possible elevation which allows the load to clear any obstacles on the ship.

Yet another object of the present invention is to provide an operator cab riding independently on the trolley girder at its low elevation so that the operator is at a closer vantage point when removing or placing a load, which allows quicker and more precise movement for making these spotting maneuvers.

Still another object of the invention is to provide structures, such as paddles extending to below the center of gravity of the load, to minimize sway of the container and to avoid the need to place undue strain on hoist cables which would otherwise be experienced without the paddles during periods of high acceleration or deceleration.

Still another object of the invention is to provide a method in which the load or unload cycle time is reduced through simplification of the individual steps of the loading or unloading process.

The invention also involves certain method aspects which are directly related to the physical techniques used in the vertically moveable trolley girder. One method involves a sequence of steps whereby the trolley girder is positioned at one elevation while operating the trolley to place cargo or remove cargo from one tier on the ship, then when that tier is loaded or discharged the trolley girder is moved to a second elevation for operating the trolley to place cargo and remove cargo from another tier on the ship. In this respect the method generally involves the process of vertically moving the trolley girder to an elevation which corresponds approximately to the higher of the following: (A) The elevation which minimizes the distance between the bottom of the spreader when it is hoisted tightly to the trolley, and the top of a designated container location on the ship to or from which a container is to be moved, or (B) The elevation which minimizes the distance between the bottom of a container attached under the spreader when it is hoisted tightly to the trolley, and the highest obstacle to be cleared by the container when it is transferred between the dock and the designated container location on the ship. When the trolley girder is at the approximate height determined by these parameters, the trolley can be operated to move cargo between the dock and the ship. These elevations apply to containers located above the deck or in removing or loading containers from the hold of the ship.

These and other objects of the present invention are achieved in a dockside crane by providing vertical frame means including support structure which rests on the dock near a waterside edge thereof; elongated girder means attached to said vertical frame means and extending horizontally over said dock and the water adjacent to said dock where a vessel can be moored for loading or unloading cargo; elevating means for vertically raising and lowering said girder means to change its elevation above said dock and a moored vessel; cargo transfer means carried by said girder means and horizontally moveable therealong over said dock and a moored vessel; and cargo engaging means suspended below said cargo transfer means by flexible support means and which can be vertically lowered to and raised from cargo locations on said dock and on a moored vessel, wherein said cargo engaging means can be raised sufficiently adjacent to said cargo transfer means, and preferably is held tightly thereagainst, so as to permit large horizontal accelerations and velocities of said transfer means with virtually no attendant sway of any cargo being transported thereby.

The invention also provides an arrangement for quickly moving a container from a source position to a destination position. The arrangement has at least one generally horizontal girder, and a trolley arranged to move along the at least one girder. The trolley includes at least a pair of opposed collector paddles defining a collector space into which the container may fit, the collector paddles having a length great enough to extend below the center gravity of the container when the container is at its highest position in the space between the collector paddles, so as to counteract acceleration-induced or deceleration-induced moments acting on the container so as to substantially prevent sway of the container.

The trolley described above may further include at least one trolley anti-lift structure and the girder may further includes at least one girder anti-lift structure, disposed with respect to the at least trolley anti-lift structure to counteract any moments tending to lift an end of the trolley longitudinally along a path of the container so as to prevent substantially prevent acceleration-induced or deceleration-induced moments acting on the trolley so as to substantially prevent sway of the trolley.

The invention further provides a trolley for transporting a container from a source position to a destination position. The trolley has a spreader adapted to receive the container, means for raising and lowering the spreader and the container, and at least one pair of opposed collector paddles, extending downward to beneath the center of gravity of the container.

Further, the invention provides a method for moving a container from a source position to a destination position. The method has the steps of lowering a spreader to grasp the container at the source location, and lifting the spreader and container to a position between at least one pair of opposed collector paddles which are offset from each other along a longitudinal path leading from the source location to the destination location. The method also involves accelerating the spreader, container, and collector paddles at a high rate of acceleration, the accelerating step beginning substantially after the lifting step has been completed, and decelerating the spreader, container, and collector paddles at a high rate of deceleration so as to arrive at a point substantially vertically above the destination location. Finally, the method involves lowering the spreader and container so as to deposit the container at the destination location.

Moreover, the invention provides a crane for moving a container from a source location to a destination location, the arrangement including at least one generally horizontal girder, a trolley movable horizontally along the at least one girder, and including a device for grasping the container, and a trolley moving arrangement for moving the trolley horizontally from above the source location to above the destination location. Further, the crane includes a movable work station including controls for allowing an operator to control at least 1) the grasping device, 2) the trolley moving arrangement, and 3) a work station moving arrangement for moving the work station independently of the movement of the trolley, so that the operator can move the work station with respect to the trolley to view the trolley from different relative positions and different relative angles.

DETAILED DESCRIPTION OF THE PREFERRED EMBODIMENTS

Figure 1:
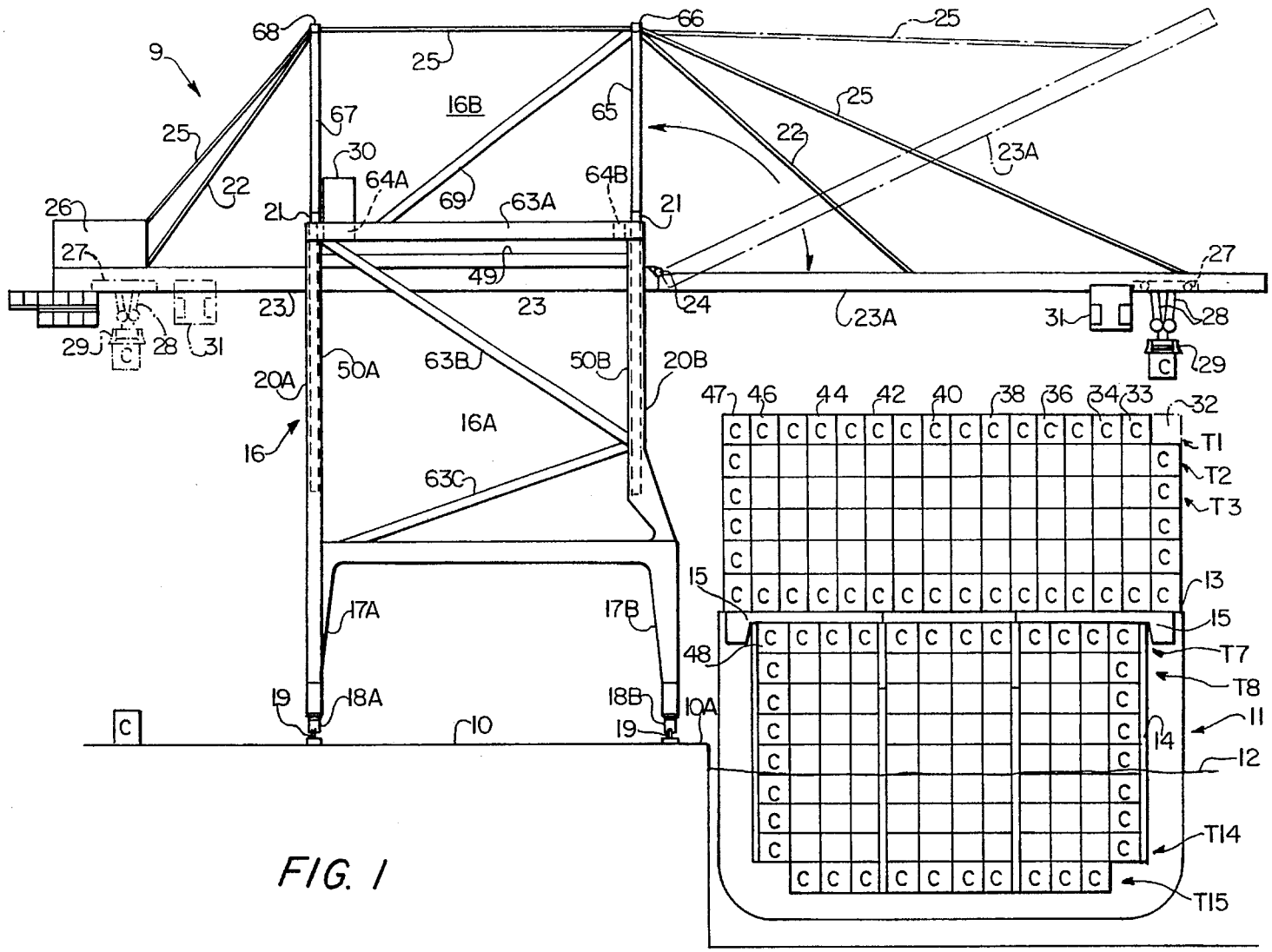
FIG. 1 is a generally diagrammatic side elevation view which illustrates the structure and operation of a crane according to the present invention, whose trolley girder is shown positioned at or near its highest elevation when transferring cargo between a dock and the upper container tiers on the main deck of a ship.

In describing the preferred embodiment of the subject invention illustrated in the drawings, specific terminology is used for the sake of clarity. However, the invention is not intended to be limited to the specific terms so selected, and each specific term includes all technically equivalent terms for steps or devices operating in a similar manner to accomplish a similar purpose.

Figure 2:
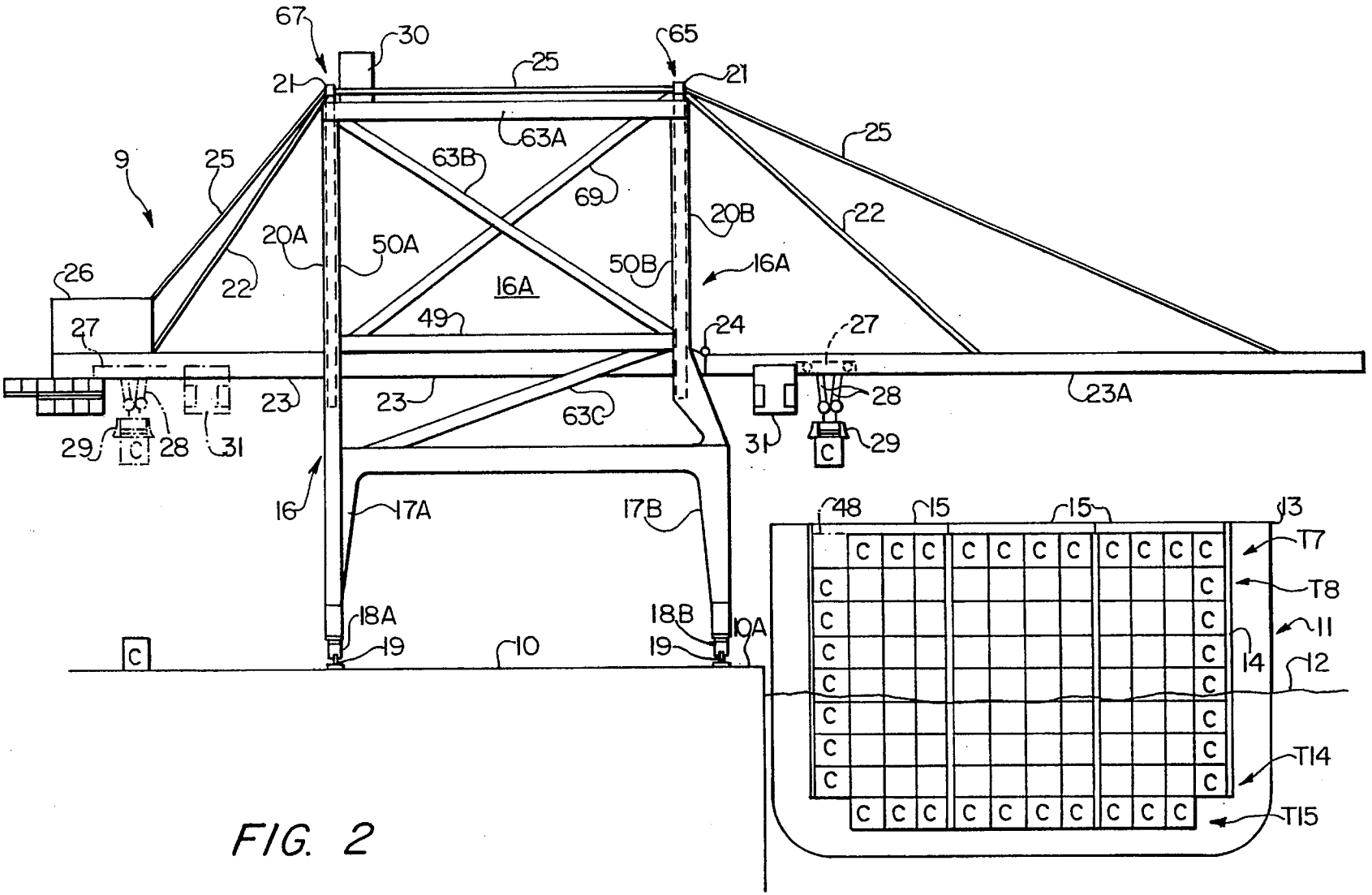
FIG. 2 is the same side elevation view of the FIG. 1 crane when the trolley girder is positioned at or near its lowest elevation during the transfer of cargo between the dock and the hold of a ship.
Figure 3:
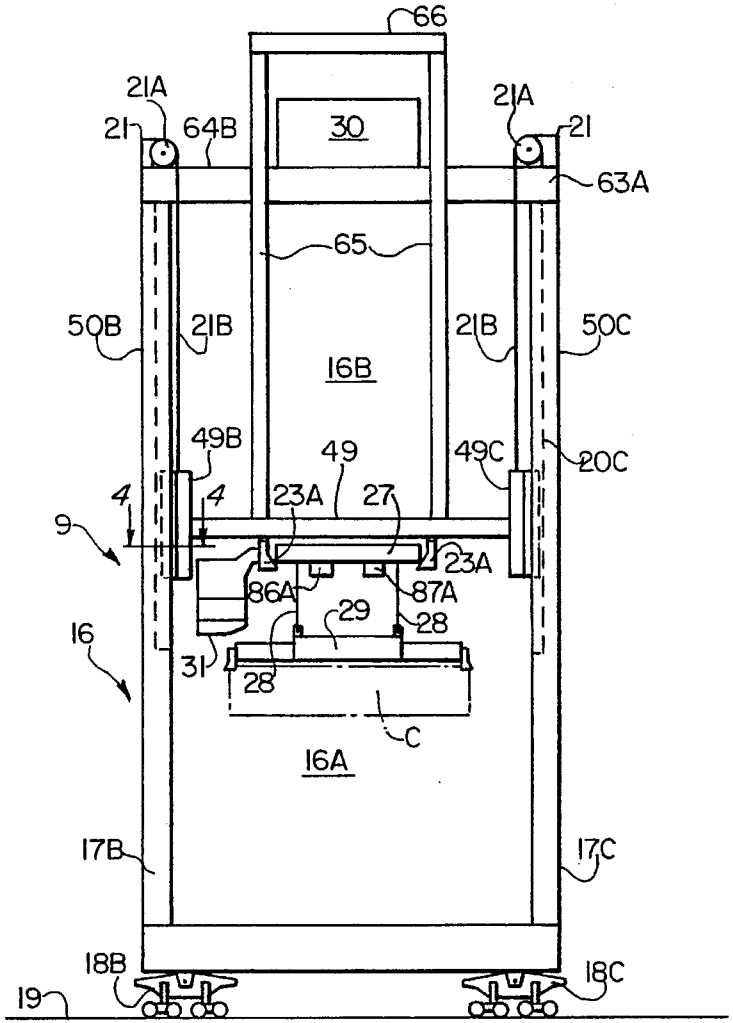
FIG. 3 is a simplified diagrammatic waterside or front end elevation view of the crane which primarily shows the general arrangement of the trolley and spreader when the trolley girder is at an intermediate elevation.

Referring first to FIG. 1 which is not drawn to scale, it will be seen that a crane 9 constructed according to the invention is located on a dock 10 to which the container ship 11 on water 12 is moored. The ship 11 has cargo containers C located in vertically stacked horizontal tiers T both below the main deck 13 in its holds 14 and on the main deck 13 above the hatch covers 15 and deck area. The crane 9 has a main vertical frame assembly 16 provided with four vertical legs 17 which support a lower braced superstructure subassembly 16A of frame 16. For illustrative purposes, the two legs 17 located behind legs 17A–17B and farthest from the viewer of FIG. 1 are omitted in the drawing as will be understood by persons familiar with cargo handling equipment of this nature. However, the FIG. 3 waterside or front elevation view of crane 9 does show a third supporting leg 17C which is behind leg 17B in FIG. 1. FIG. 3, as well as other figures in these drawings, also is not to scale and its size has no particular one-to-one relationship to the size of crane 9 in FIGS. 1 and 2. Moreover, the illustrated sizes of various components in the drawings are not necessarily proportional to the sizes of these components in actual practice. Also omitted from the drawings are the customary ladders, stairways and railings used by personnel for access to the upper levels of the crane. The entire crane 9 is moveable parallel to and longitudinally along the waterside edge 10A of dock 10 on support wheel assemblies 18 which ride on a set of spaced-apart rails 19.

The lower superstructure assembly 16A has four fixed vertical legs 50 which rise from the four support legs 17. Each side of crane 9 has its dockside (rear) and waterside (front) legs 50 braced by a horizontal sill beam 63A connecting their tops, and by the lower diagonal braces 63B and 63C, as shown for the rear leg 50A and front leg 50B in the FIG. 1 side elevation view. Rear and front horizontal shoulder beams 64A and 64B are transversely connected between the two side sill beams 63A and are respectively spaced inwardly from the rear and front ends of these sill beams in order to provide lateral support to the top of superstructure 16A. The front shoulder beam 64B is shown in FIG. 3, behind which is the rear shoulder beam 64A (not visible in FIG. 3) near the rear of the lower superstructure 16A.

An upper braced superstructure subassembly 16B of frame 16 is positioned on the lower superstructure subassembly 16A for movement up and down with respect to the lower superstructure. This upper superstructure 16B includes a vertically moveable platform 49 with corner legs stabilized in a set of guide channels 20 on the four vertical legs 50 of superstructure 16A. FIG. 3 shows two such platform front corner legs 49B and 49C which vertically extend a short distance below and above platform 49, and which are respectively associated with the front legs 50B and 50C of the lower superstructure 16A. The two corners at the dockside rear end of platform 49 also have similar short vertical legs like legs 49B and 49C.

This platform 49 of the upper superstructure 16B can be raised and lowered by a set of four motorized elevating winch assemblies 21, or alternatively by hydraulic devices, which are located on sill beams 63A above the tops of the vertical legs 50 of the lower superstructure 16A. A separate winch assembly 21 for each leg 50 is used to adjust the height of the adjacent platform corner leg 49. Each winch assembly is of conventional construction and may consist, for example, of a DC motor driven by a DC motor drive for turning a drum 21A about which four wire ropes 21B are attached. The lower ends of these four ropes are connected to the associated platform corner leg 49 above the center of gravity of the upper superstructure 16B, including its platform 49 and the trolley girder 23/23A connected thereto. A conventional master/slave control system is employed for these four winch assemblies 21 to coordinate and synchronize their operation when vertically moving the platform 49.

Figure 4:
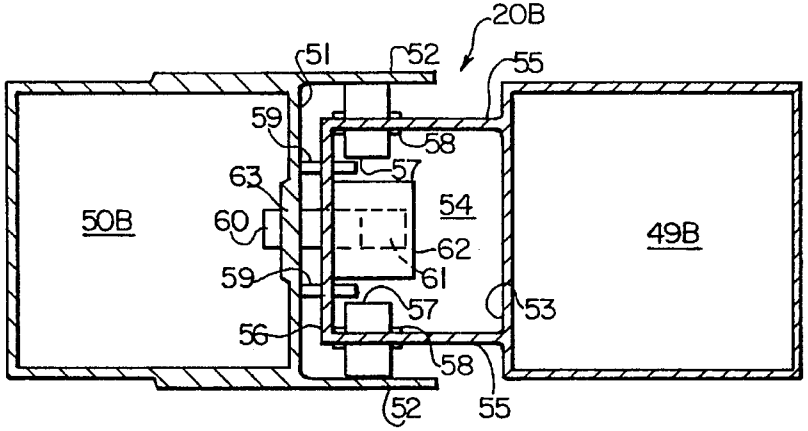
FIG. 4 is a top sectional plan view of a fixed lower superstructure leg and its associated moveable platform corner vertical leg.

FIG. 4 is a top sectional plan view of the fixed lower superstructure vertical leg 50B consisting of a box beam, which also shows its adjacent platform corner leg 49B slidably engaged in the associated guide channel 20B. Guide channel 20B is formed along the length of an exterior wall 51 of leg 50B by two projecting, spaced-apart parallel arms 52. The vertically moveable leg 49B, also a box beam in cross section, has a guide frame 54 formed along the length of its exterior wall 53. Guide frame 54 faces and extends into guide channel 20B so that its two side walls 55 are spaced apart from and are parallel to arms 52 of guide channel 20B. The end wall 56 of guide frame 54 faces and is spaced apart from the exterior wall 51 of leg 50B which also acts as a wall of guide channel 20B. FIG. 4 further shows a pair of horizontal, spaced apart guide rollers 57 near the lower end of leg 49B and below the center of gravity of the upper superstructure 16B and trolley girder 23/23A. Each roller 57 has a horizontally disposed axis 58 which is held parallel to, and within an aperture of, a respective side wall 55 of guide frame 54 so that the guide roller cylindrical surface rolls against the adjacent guide channel arm 52 as leg 49B is vertically moved. Guide rollers 57 therefore prevent lateral motion of leg 49B in the "Y" direction as shown in FIG. 4. Another pair of guide rollers 59 is also provided in end wall 56 of guide frame 54 for rolling against the adjacent guide channel wall 51. These guide rollers 59 will prevent lateral motion of leg 49B in the FIG. 4 "X" direction when acting in concert with corresponding guide rollers 59 on the opposite front leg 49C which is in line with leg 49B along this "X" direction. If necessary, several pairs of guide rollers 57 and 59 may be provided along the length of guide frame 54 to the extent needed for the stability of leg 49B as it is raised or lowered. FIG. 4 is also representative of the mechanical construction of the other three combinations of legs 50 and platform legs found in the crane 9.

Means are also provided in FIG. 4 to positively lock leg 49B in place after its vertical motion ceases. This means can include a horizontal safety shear pin 60 which is slidably retained in a recess 61 formed within a safety assembly 62 that is held by end wall 56 of the guide frame 54. Pin 60 is moved by safety assembly 62, using hydraulic pressure or some other moving force, so that it can extend into or retract from a hole 63 in wall 51 of leg 50B. A plurality of holes 63 are provided along the length of wall 51 so that pin 60 can be engaged with a hole 63 at different elevation levels of leg 49B. Alternatively, pin 60 and safety assembly 62 may be replaced by other arrangements such as a ratcheting cam which engages ridges formed in wall 51 in order to provide more stopping places for leg 49B along leg 50B than can be achieved by the shear pin 60-hole 63 combination.

As part of the upper superstructure 16B, the front of platform 49 also supports a pair of spaced-apart, vertical columns 65 which extend upwardly in front of shoulder beam 64B and whose tops are connected together by a front cross beam 66. As shown in FIGS. 1 and 3, these columns 65 are in line with the front vertical legs 50B and 50C of the lower superstructure 16A. In similar fashion, a pair of spaced-apart, vertical columns 67 in line with the rear vertical legs 50 also extend upwardly from the rear of platform 49 and to the rear of shoulder beam 64A. The tops of columns 67 are joined by a rear crossbeam 68. A pair of spaced apart side braces 69 also extend downwardly from the tops of columns 65 to the rear of platform 49.

The upper superstructure 16B is also connected to and supports an elongated trolley girder 23 which includes a boom member 23A. Trolley girder 23 is attached to the underside of the vertically moveable platform 49, and it is also supported by structural stays 22 which are connected from the tops of the front and rear columns 65 and 67 to girder 23 and its boom 23A. This trolley girder 23 extends horizontally over the dock 10 with its boom 23A also horizontally extending over water 12. Thus, when the upper superstructure 16B is vertically moved by elevating means 21, girder 23 including its boom 23A also is raised or lowered to change its elevation above dock 10 and ship 11.The boom 23A is also hinged along the trolley girder 23 at point 24, allowing the boom 23A to be pivotally raised and stowed when not in use as shown by its dashed line position in FIG. 1 which in practice can be nearly vertical. Boom 23A is rotated around the hinge point 24 by wire cables 25 which are reeved through the tops of columns 65 and 67 of superstructure 16B and are attached to a motorized winch located in a machinery house 26 at the dockside or rear end of trolley girder 23. The stowed boom position allows for the free movement of ships alongside the dock and for the crane to move without interference alongside a moored ship. Alternatively, the trolley girder 23 could be horizontally retracted landside on rollers as a single piece, or be comprised of slidable telescopic sections, so as not to interfere with moored ships or those which are approaching or leaving the dock.

A cargo transfer trolley 27 on wheels or other support means is carried by troller girder 23 and is moveable horizontally along nearly the entire length of the girder including its boom member 23A. Trolley 27 is horizontally moved along girder 23 by conventional wire ropes which are driven by motors also located inside the machinery house 26. Suspended below the trolley 27 by flexible support means, such as a pair of spaced-apart wire ropes 28, is a vertically moveable cargo engaging means like a spreader 29 with conventional twist lock mechanisms at its four corners for removable attachment to the corner castings of a standard cargo container C. The spreader 29 can be vertically lowered to and raised from cargo container locations on dock 10 and ship 11 by the wire ropes 28.

Figure 5:
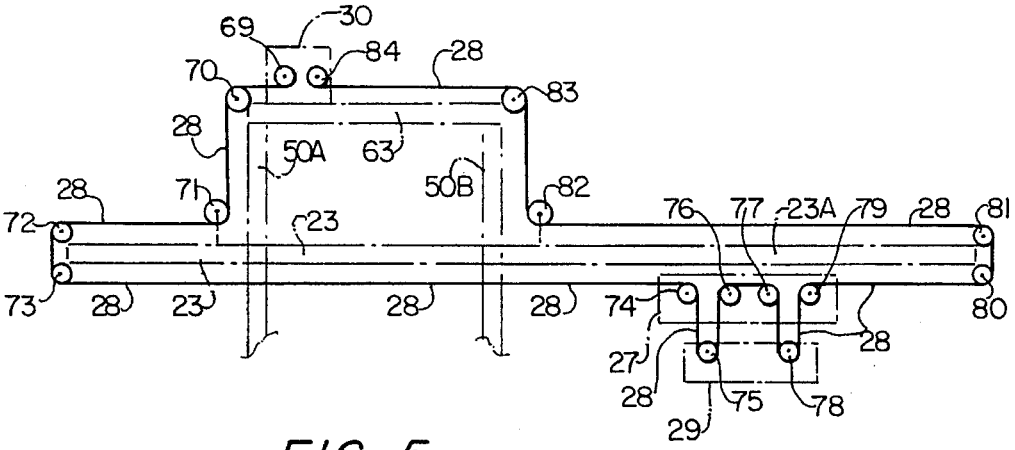
FIG. 5 is a schematic diagram showing the path taken by the cargo hoisting ropes along the crane components.

Hoisting of the container load (i.e., raising the spreader 29 and container C vertically toward the trolley) is accomplished by a motorized winch located in a fixed machinery house 30 on the rear shoulder beam 64A at the top of the lower superstructure 16A. With reference now to FIG. 5, this winch includes a main hoist drum 69 which is connected to the wire ropes 28 that are reeved from machinery house 30 over sheaves 70 on the lower superstructure and down to sheaves 71 on trolley girder 23. Ropes 28 next are reeved over sheaves 72–73 at the girder's rear end and back along girder 23 to the trolley 27 and spreader 29. Trolley sheaves 74 pass the ropes 28 down to the spreader sheaves 75, then back up to the trolley sheaves 76 and 77 from which ropes 28 go back down to spreader sheaves 78. Ropes 28 next go back up to trolley sheaves 79 and then to sheaves 80 and 81 at the waterside end of boom 23A. The ropes 28 then return through sheaves 82 on trolley girder 23 and up by way of the lower superstructure sheaves 83 to the hoist machinery house 30 where they are connected to take up drums 84 for eliminating slack when the upper superstructure 16B is moved vertically. These hoist ropes 28 can be shortened so that spreader 29 is raised sufficiently adjacent to trolley 27, and preferably is held tightly against the trolley, so as to permit large horizontal accelerations and velocities of the trolley with virtually no attendant sway of any cargo container transported thereby. However, this close proximity of spreader 29 to trolley 27 during horizontal travel is not necessarily shown in all the drawings for the sake of simplicity.

Figure 6:
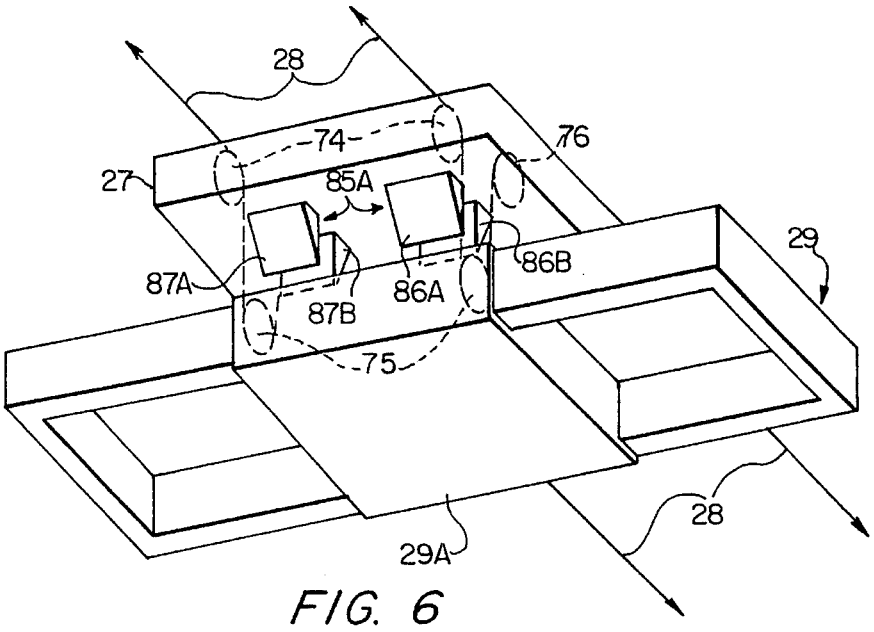
FIG. 6 is a perspective view of a trolley and spreader construction which employs collector assemblies for preventing cargo sway.
Figure 7:
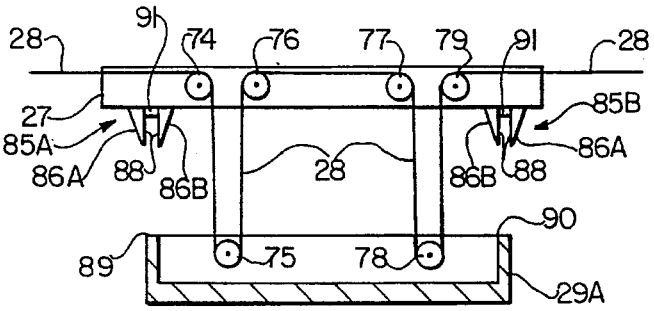
FIG. 7 is a simplified side view of the trolley and spreader components shown in FIG. 6.

Reference is now made to FIGS. 6 and 7 for the details of a trolley 27 and a spreader 29 that permit tight contact between these two devices when transporting cargo. Trolley 27 contains the previously described sheaves 74, 76, 77 and 79 over which pass the pair of hoist ropes 28. A collector assembly 85A is also located on the bottom exterior surface of trolley 27 near the rear end thereof, while another trolley bottom collector assembly 85B is located at the front end of trolley 27. The hoisting ropes 28 extend downwardly between these two collector assemblies. In the preferred embodiment, each collector assembly comprises two transversely aligned pairs of spaced-apart, downwardly extending collector elements 86A–86B and 87A–87B. The collector elements in each pair have opposite facing vertical surfaces 88 which are separated by a gap. The spreader 29 includes the previously discussed sheaves 75 and 78 which are rotatably held in the center box-like member 29A. Box 29A is open at its top, and is of such size that the top edges of its rear and front walls 89 and 90 will fit snugly into the gaps between the pairs of collector elements 86A–86B and 87A–87B. Thus, the trolley collector assemblies will hold the spreader 29 tightly against trolley 27. Compression bumper pads 91 also may be located under trolley 27 in the collector element gaps so that they will make contact with the top edges 89 and 90 of the spreader box 29A. Such pads 91 will permit an even tighter fit of spreader 29 against trolley 27 in order to further reduce load sway at high horizontal accelerations and fast horizontal velocities. Velocities up to or over 1000 feet/min. and accelerations of 6 to 8 feet/see/see presently appear to be feasible.

It will be noted in connection with FIGS. 5 and 7 that the hoist ropes 28 vertically fall from trolley 27 to spreader 29 so that the spreader can be hoisted directly into the collector assemblies and there held tightly against the trolley. However, if the trolley/spreader sheaving configuration is such that ropes 28 do not have this straight fall but instead are at an angle with each other as diagrammatically illustrated in FIGS. 1 and 2, collector assemblies may not be appropriate or useful since it may not be possible to lift the spreader high enough to actually contact the trolley. In this case, however, it should still be possible to raise the spreader to be sufficiently adjacent to the trolley for using the opposing tension of ropes 28 so as to permit large horizontal accelerations and velocities of the trolley with virtually no attendant sway of the cargo.

The operation of all motors and the consequent movements of the trolley 27 and spreader 29 are normally controlled by an operator stationed in a control cab 31 which also is carried by and is free to move horizontally along the outside of trolley girder 23 and its boom 23A under operator control independently of the motion of trolley 27. In the course of operating the system, the trolley 27 and spreader 29 carry containers C between the ship and the dock. It will be recognized by those skilled in the art that statements made herein about movements to and from the dock envision that a container may be landed on or hoisted from the dock itself, a vehicle bed or other equipment located on the dock. The elevation of the upper superstructure 16B and girder 23 is additionally controlled by the operator in cab 31 to the level which minimizes the distance between the spreader 29, when held very close to or tight against the trolley 27, and the highest elevation of a designated container location or the highest obstacle to be cleared by a trolley-suspended container. FIG. 1 shows the trolley girder 23 located at or near its highest elevation level, while FIG. 2 shows girder 23 to positioned at or near its lowest elevation level. Of course, girder 23 can also be vertically moved to various intermediate levels according to what is required by the job at hand, as represented by FIG. 3.

The disclosed crane system of the present invention has many advantages over conventional, single trolley dockside gantry cranes or the several dual trolley dockside gantry cranes that are known in the art. For one thing, the crane operator in moveable cab 31 on the vertically adjustable girder 23 is considerably closer to the location of loading or unloading a container on a ship, as well as being nearer to the point of spotting the position of a container location on the dock. This operator proximity will minimize parallax for the operator so that his ability to position the spreader 29 and/or container C is considerably enhanced. Cab 31 also can move independently on girder 23, rather than being on and moving with the trolley 27, which allows more comfortable travel for the operator between vantage points over the ship and dock. This independently moveable cab 31 further allows large horizontal accelerations and velocities of the trolley 27 without adversely affecting the operator. Because the trolley girder 23 is vertically positioned as close as possible to the designated container location on the ship, the spreader 29 and its engaged container C can be quickly hoisted and held tightly against the trolley 27 so that sway during horizontal movement will be virtually eliminated to allow such large accelerations and velocities which considerably decrease cycle times. Another distinct advantage of the present invention over the dual hoist crane is the reduced complexity of the operating equipment with a consequent reduction in cost. Equally important, there is only one operator, thereby reducing by 50% the labor required to operate this crane as compared to the dual hoist variety. Computer simulations also have shown the crane of this invention to have an almost equivalent throughput capacity of the fastest known dual hoist crane.

The controls for the trolley and spreader movements also may be computerized or otherwise automated to assist the operator of the crane. It is possible with presently available data systems to memorize the coordinates of container locations on the ship as well as the coordinates of container landing positions on the dock, so that the movements of the spreader and the containers can be programmed to automate the cycle in nearly every respect. This automation is enhanced by the fact that virtually no sway is encountered in the horizontal movement of the container from ship to dock, and vice versa. Any minor sway as a result of location spotting movements can be ameliorated through collectors and through minimal operator interface at either end of the cycle. Coordinate locations also can be easily and quickly updated in response to events such as changes in the trolley girder elevation and changes in the ship's draft due to loading or unloading.

The preferred novel methods of operating the disclosed novel crane 9 will now be described in more detail. In general, when a container C is being loaded on board a ship 11 or off loaded therefrom, the trolley girder 23 is vertically positioned at an elevation referred to herein as an "advantageous elevation," which corresponds approximately to the higher of the following:

A. The elevation which, to the extent practical, minimizes the distance between (1) the bottom of the spreader 29 when it is hoisted tightly (or as close as possible) to the trolley 27, and (2) the top of a designated container location on the ship to or from which a container is to be moved, or B. The elevation which, to the extent practical, minimizes the distance between (1) the bottom of a container attached under the spreader 29 when it is hoisted tightly (or as close as possible) to the trolley 27, and (2) the highest obstacle to be cleared by the container when it is moved between the dock and the designated container location on the ship.

In loading a moored ship 11 with containers C that have been delivered to the dock 10, the usual procedure is to first move the crane on rails 19 to a designated longitudinal position along the waterside edge 10A of the dock where the crane then will be used to fill a lower horizontal and transverse tier of container locations on the ship before placing containers in the next higher horizontal tier that is immediately above this filled tier. Thus, after so longitudinally positioning crane next to the ship, the trolley girder 23 initially is vertically moved to the "advantageous elevation" for the designated locations in the first lower tier to be filled with containers during a particular loading period of time. The trolley 27 is then moved over the dock so that its spreader 29 can pick up a container C therefrom. After hoisting this container to the vertical position where the spreader 29 is held tightly (or nearly so) against the trolley 27, the trolley moves horizontally along girder 23 and over the ship to a point immediately above the lower tier designated location where the container is to be placed. The container is then lowered to its resting position on the ship.

These trolley and spreader motions are essentially repeated until this lower tier is filled, whereupon the trolley girder 23 is positioned at the "advantageous elevation" for the designated container locations in the tier immediately above the now-loaded lower tier. This usually requires that the girder 23 be raised if containers are being loaded in tiers above the main deck 13 as shown in FIG. 1. However, when the crane is used first to load containers in any tier below the main deck areas of the ship (i.e., in the hold 14), the trolley girder 23 is usually positioned and maintained at the same "advantageous elevation" such that the tightly hoisted spreader 29 and container C will clear the ship's side hull and any higher obstacle between the dock and the container's designated tier location in the hold. If the main deck at this time is free of interfering containers directly above the hold tier being loaded and there are no significant rails, gunnels or other above deck or dock obstacles, the trolley girder 23 would be positioned either at its lower stops or at an elevation where the tightly hoisted container will just clear the hatch covers 15 if they have not already been removed. Thus, when loading containers below deck, the same "advantageous elevation" of girder 23 will generally be maintained until such loading ceases for any reason. The trolley girder 23 is moved upward in increments, as needed, to successive advantageous elevations as containers are positioned in stacked multi-level tiers above the main deck of the ship. The crane then may be moved to another longitudinal dockside position in order to load containers into ship transverse tiers that are opposite this crane position.

Off loading the vessel is essentially the reverse of the procedure described above, in that the containers in upper tiers are first moved from the ship to the dock and the trolley girder 23 is incrementally lowered, when necessary, to the required advantageous elevations.

When it is desired to remove the hatch covers 15 in the course of off loading or in preparation for loading, this task can be performed using the trolley 27 to take the hatch cover 15 either between the legs 17 of the crane or behind the most landside leg. The hatch cover 15 is then lowered onto the dock surface where it is released so the trolley 27 can return to load or off load the ship.

By way of a particular example, as illustrated in FIG. 1, assume that it is desired to move a container C between the dock 10 and the most waterward container location 32 in the topmost, above deck tier T1 on the ship, either in a landward off loading direction or in the waterward loading direction. The upper superstructure 16B with trolley girder 23 is preliminarily moved to the advantageous girder elevation that allows the bottom of this container C to clear by a very short distance the containers C in tier locations 33–47 when the spreader 29 is hoisted tightly against the trolley 27. However, this clearance distance as well as the spreader-trolley distance are exaggerated in the non-scale FIG. 1 for the sake of simplicity. The container C then is transferred by the trolley 27 from its initial location on the ship or the dock to its appropriate destination. This advantageous elevation for container location 32 also would be the advantageous elevation for containers moved to or from inner tier locations such as 36, 38 and 40, for example. Alternatively, the advantageous elevation for the most landward container location 47 in tier T1 can be approximately one tier lower so as to minimize the distance between the bottom of the tightly hoisted spreader 29 and the top of container location 47, since there are no intervening obstacles between this location and the dock.

Now assume that it is desired to remove a container C from tier location 48 of tier T7 in the hold 14 of the FIG. 2 ship where there are no above deck containers over this location. The trolley girder 23 is moved to its lowest elevation shown in FIG. 2, where it will remain during the unloading of any container from the vertically stacked horizontal tiers T7–T15, provided there are no containers still remaining on the deck above these tiers. This advantageous elevation will permit the bottom of any removed container to clear the ship's side hull as the container is transferred landward by trolley 27 with spreader 29 held tightly against the trolley.

In summary, it will be appreciated that in order to minimize vertical container movements and allow large horizontal trolley accelerations and velocities, the trolley girder should be positioned in its lowest possible elevation that allows clearance of the trolley, spreader, and container over any remaining obstacles between ship and dock while having the spreader held tightly, or nearly so, against the trolley. Thus, it is evident that this invention provides an extremely simple and versatile system and method which can significantly speed up the rate at which containers are loaded and unloaded from container vessels. This advantage over other prior art cranes accrues because of reduced operator parallax, closer operator proximity to the attaching/detaching container locations, and greater horizontal accelerations and velocities heretofore unobtainable because of load sway below the trolley during horizontal travel.

Figure 8A:
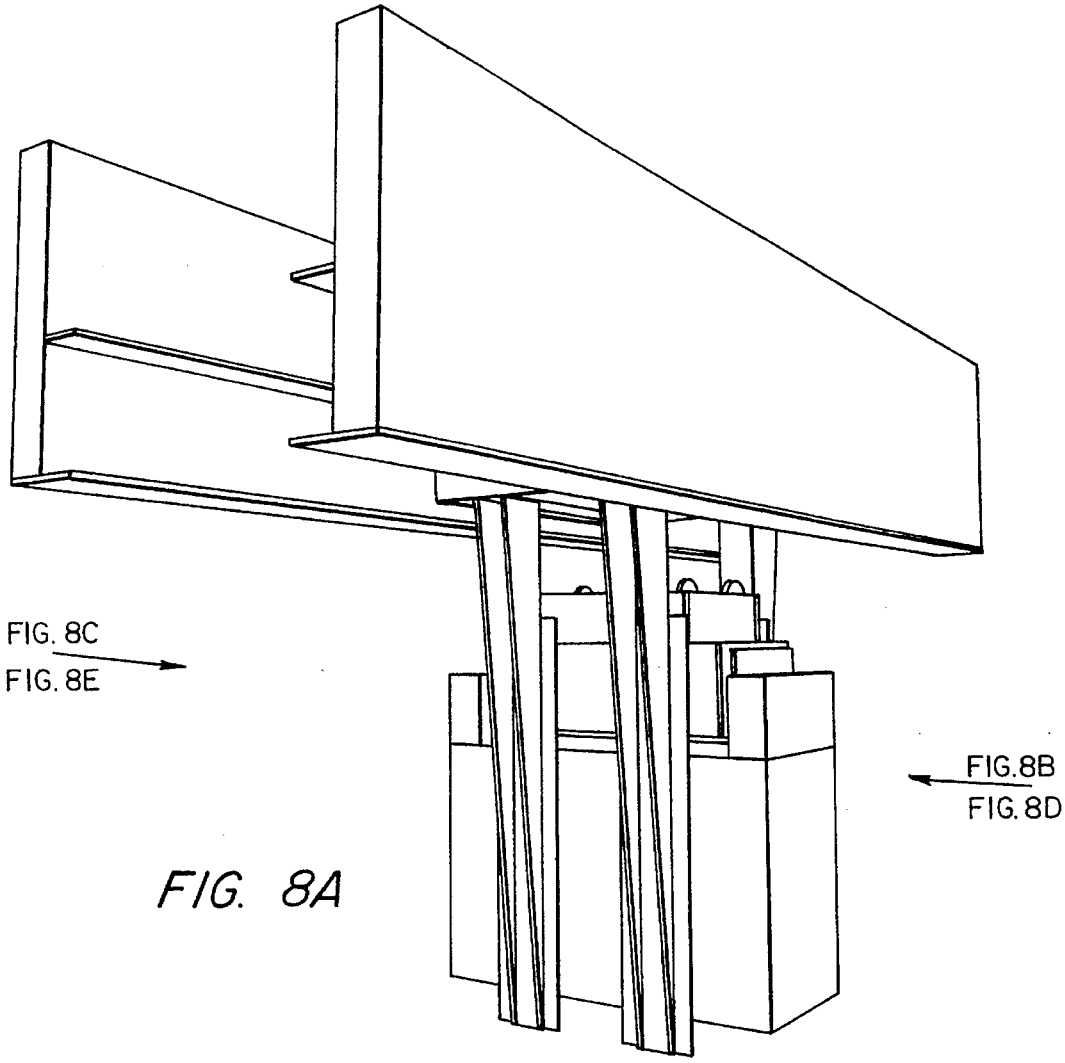
FIG. 8A is a perspective view of a trolley according to an embodiment of the invention.
Figure 8F:
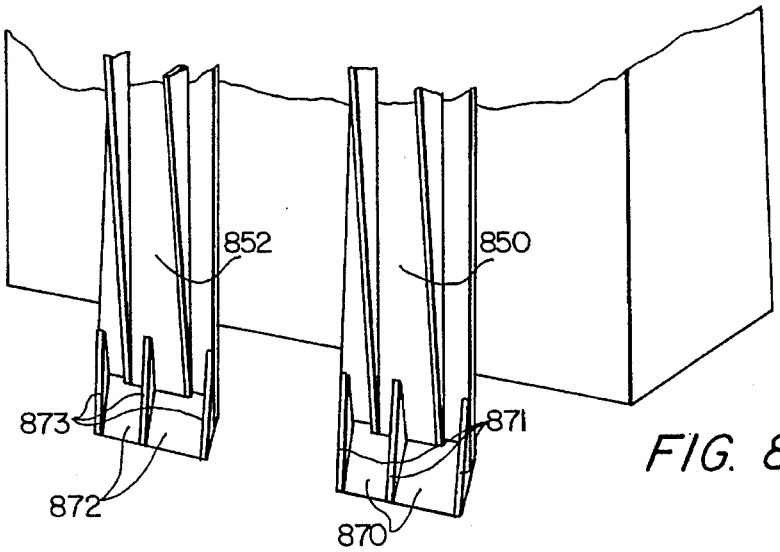
FIG. 8F is an enlarged perspective view showing an alternative embodiment of paddles in which collector pads are employed on the lower ends thereof.
Figure 8B:
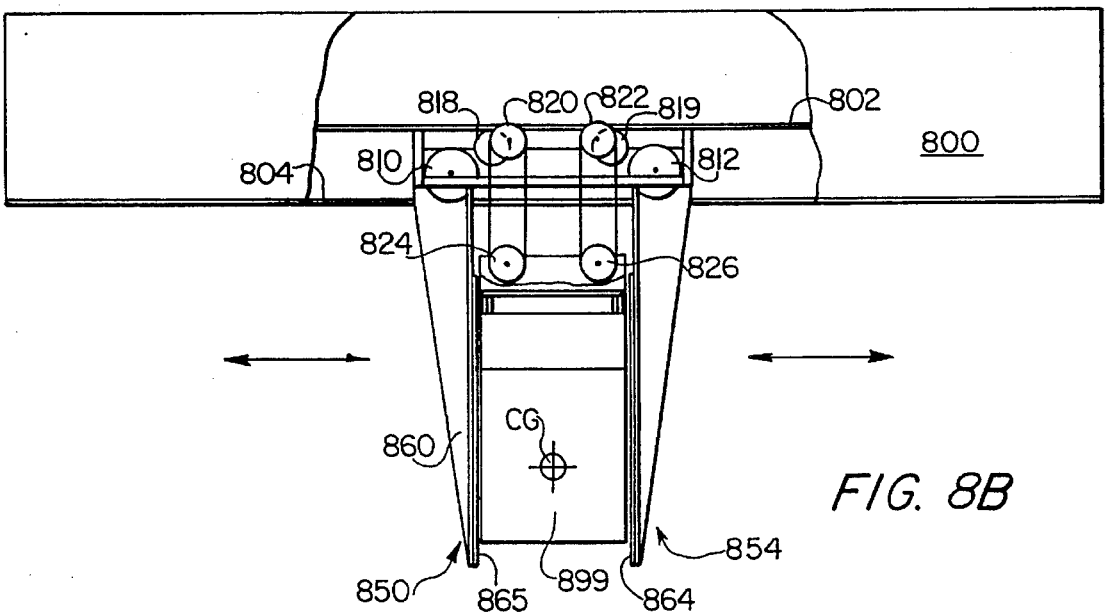
FIG. 8B is a side view thereof.
Figure 8C:
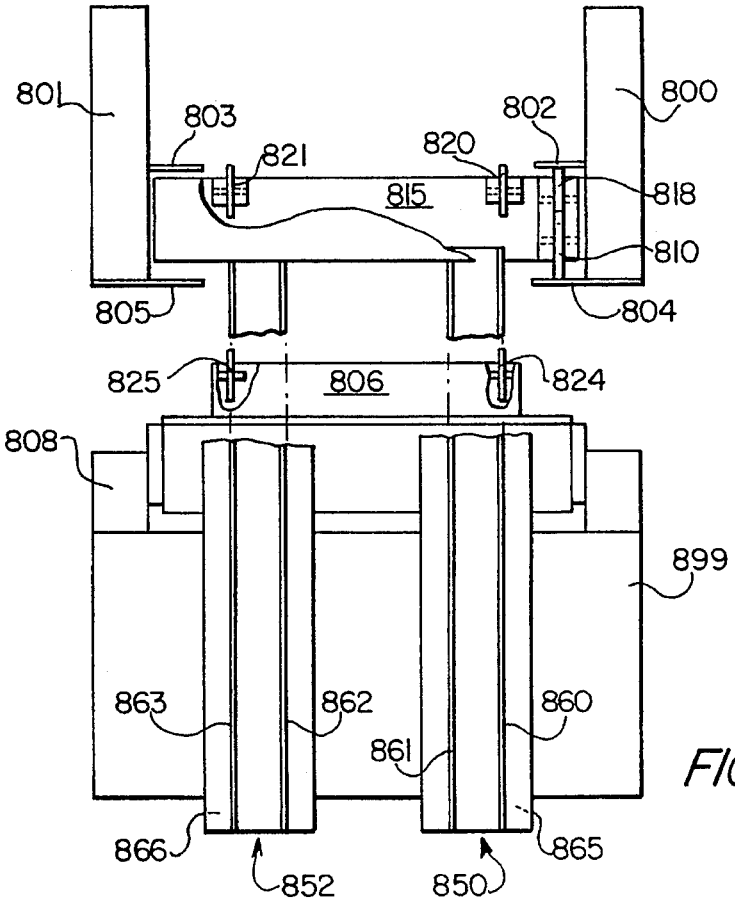
FIG. 8C is an end view thereof.
Figure 8D:
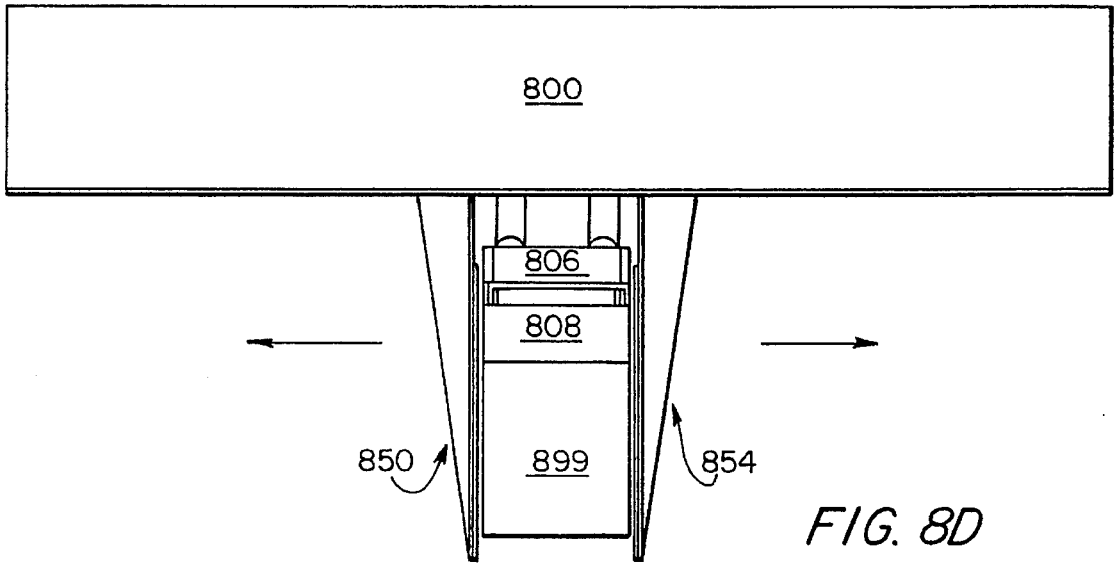
FIGS. 8D and 8E correspond to FIGS. 8B and 8C, respectively, but do not show the hidden features of the embodiment.
Figure 8E:
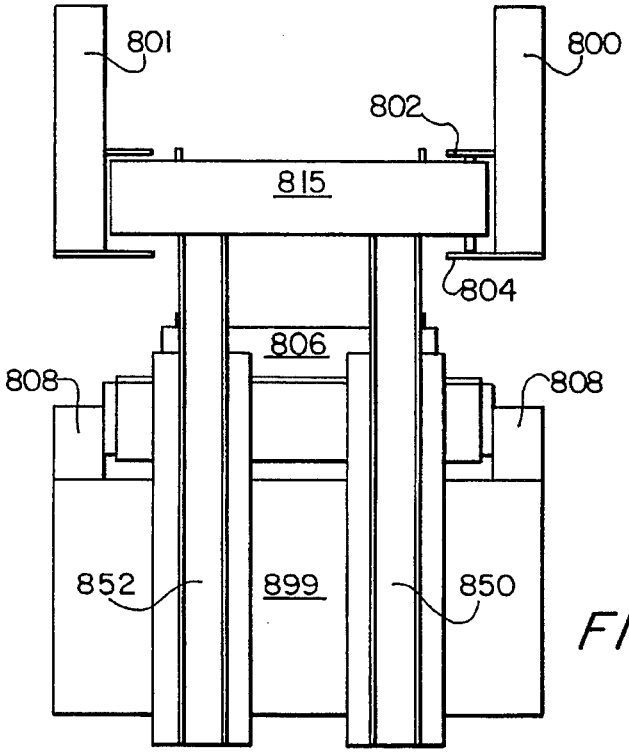

FIG. 8A is a perspective view of a trolley according to an embodiment of the invention. FIG. 8B is a side view thereof. FIG. 8C is an end view thereof. FIGS. 8D and 8E correspond to FIGS. 8B and 8C, respectively, but do not show the hidden features of the embodiment. FIG. 8F is an enlarged perspective view showing an alternative embodiment of paddles in which collector pads are employed on the lower ends of the paddles.

Referring especially to FIGS. 8B and 8C, the trolley is supported beneath parallel trolley girders 800, 801. Girder 800 is provided with roller support flange 804 on its inner surface, facing trolley girder 801. Similar, trolley girder 801 is provided with roller support flange 805. Flanges 804, 805 constitute tracks on which trolley rollers travel. Only two trolley rollers, elements 810, 812 which travel atop flange 804, are illustrated in FIG. 8B, and only trolley roller 810 is illustrated in FIG. 8C for the sake of simplicity. However, it is understood that other trolley rollers travel atop flange 805 (FIG. 8C). Trolley rollers 810, 812 bear the weight of the trolley as the trolley moves longitudinally down the channel. Trolley rollers are omitted on the left side of FIG. 8C for purposes of clarity.

Girders 800, 801 are also provided with respective anti-lift flanges 802, 803. Anti-lift rollers 818, 819 are situated beneath the anti-lift flange 802, with the understanding that anti-lift flange 803 is similarly situated above anti-lift rollers on the opposite side of the trolley.

Roller support flanges 804, 805 and anti-lift flanges 802, 803 form respective longitudinal channels on the inner surfaces of girders 800, 801. The various rollers are retained within the channels as the trolley travels longitudinally beneath the girders, as indicated by the horizontal bi-directional arrows in FIG. 8B.

The trolley itself includes a head block 806 and a spreader 808. The spreader 808 is disposed between opposing pairs of collector paddles when the head block and spreader are in their highest position. Three collector paddles are illustrated as elements 850, 852, 854. A fourth collector paddle is understood to be present opposite paddle 852 alongside paddle 854. The collector paddles are preferably arranged in pairs, opposite each other longitudinally along the path to be traversed by the trolley and a container 899.

The container 899 is supported by spreader 808 within a collector space defined by the inner surfaces of the collector paddles. In particular, collector paddles 850, 852, and 854 are illustrated as having inner surfaces 865, 866, 864 respectively. In the illustrated embodiment, there is a suitably small clearance between the container 899 and paddle inner surfaces 864, 865, 866, such as four inches. The clearance is preferably chosen to be large enough to allow the container to be raised vertically into the collector space with minimal danger of collision, but small enough to minimize and distribute the force of impact between the container and paddles when the trolley accelerates or decelerates.

The collector paddles are provided with braces to increase the effective strength of the paddles during periods of acceleration and deceleration of the trolley. In particular, collector paddle 850 is provided with braces 860, 861. Collector paddle 862 is provided with braces 862, 863. Other collector paddles are provided with their own respective braces.

The trolley is provided with an upper block 815 with trolley hoist wire sheaves 820, 821, 822. It is understood that a corresponding hoist wire sheave near a fourth corner of the upper block is provided, although not visible in the drawings. Hoist wires extend from hoist wire sheaves 820, 821, 822 to head block hoist wire sheaves 824, 825, 826, respectively. In a manner appreciated by those skilled in the art, or as apparent from FIG. 5, by drawing a length of hoist wire through the sheaves, the head block and spreader assemblies, with or without an engaged container, is raised or lowered. In the illustrated embodiment, the upper block 815 and the combination of head block 806 and spreader 808 are relatively positioned so that any load 899 is drawn vertically upward into the collector space between the inner surfaces 864, 865, 866 of the collector paddles.

A preferred method of operation of the illustrated trolley arrangement is now described.

The head block and spreader are lowered from the trolley to grip the container 899. The particular manner in which the container is gripped may vary, and may be chosen in accordance with principles and standards known to those skilled in the art. For example, ISO-specified standards for twistlocks may be used, although the present invention is not limited to operation with such standards.

To allow this lifting, the trolley hoist wires lift the spreader and container vertically, into the space between the collector paddles. In the preferred method of operation, the trolley is not moving in the horizontal direction during the lifting, so that the spreader and container will preferably move straight vertically, with minimal or no horizontal movement. After reaching the collector space, the spreader and head block may be held upward, tightly against the trolley, to prevent or minimize sway. However, as described below, holding the spreader and head block tightly against the trolley is not necessary, because of other provisions of the invention.

Then, the trolley is accelerated in a horizontal direction to achieve a peak velocity as soon as possible, to utilize the maximum potential of the motors and drive gear moving the trolley. This use of maximum potential of the motors and drive gear minimizes the time for moving the container between the source location and destination location for the container. Thereafter, the trolley is decelerated to a stop, directly above the destination location. This is in contrast to known arrangements in which acceleration and deceleration magnitudes are limited by the length of the load pendulum. It is also in contrast to embodiments in which an operator work station ("cab") moves with the trolley, in which operator safety requires use of a slower-moving trolley.

Because of the construction of the trolley and especially the collector assembly, sway of the trolley itself, and sway of the container within the trolley's collector space, are substantially prevented.

Finally, because the container and trolley have little or no sway, the container can be immediately lowered to its destination position.

The trolley, now without a container, can quickly be returned to the source location for a next container, using the steps described above. The spreader and head block are simply returned to the trolley assembly for quickly returning to the source location for the next container.

The illustrated trolley is designed for very large-magnitude acceleration and deceleration. Especially when moving large or heavy containers, the problem of sway has plagued conventional trolleys. Such sway has slowed cycle time, demanded a high level of skill of crane operators, and/or necessitated expensive and elaborate sway-counteracting mechanisms. However, several features in the illustrated trolley overcome the problems of sway which are particularly acute when the large-magnitude acceleration and deceleration needed for fast loading and unloading cycle time is desired.

First, by holding the spreader and container tightly in place, the sway of the spreader-container during subsequent horizontal acceleration and deceleration is substantially prevented. This occurs for the same reason as for the embodiment shown in FIGS. 6–7, described above. This sway prevention is in contrast to many known trolley schemes, in which sway is allowed to develop but is counteracted or compensated for in some way.

Second, as a further important feature of the illustrated embodiment, the collector paddles extend beneath the center of gravity "CG" of the load. This ensures that sway is substantially prevented in the load itself, to a degree not possible when shorter paddles are employed.

If paddles did not extend below the instantaneous center of gravity of the container, the container would develop a moment that could not be counteracted by the paddles. Whereas certain shorter paddles might prevent sway from developing, the shorter paddles could not prevent excessive tension from developing in the cables which raise and lower the head block and spreader. According to the illustrated paddles, such moments and such sway, as well as excessive tension on the lifting wires, are all avoided.

Moreover, the paddles avoid the need to keep the hoist wires in a state of high tension. Such high tension may be necessary if the spreader and head block were held tight against the trolley assembly. Here, the paddles prevent sway without having to resort to such a measure.

In the illustrated embodiment, the paddles extend below the bottom edge of the container. However, the length of collector paddles in a given embodiment should be governed by the expected position of the center of gravity ("CG") of the containers expected to be encountered. The collector paddles should extend beneath this expected position of the center of gravity, so that moments and their resultant forces on the hoist wires, can be avoided.

The collector paddles must be long enough, and positioned close enough to the container, to contact the container in a manner which will not damage the container or any portion of the trolley itself. In the illustrated embodiment, this is accomplished by providing substantially large surface areas on the inner sides of the collector paddles, so that areas of contact are large, and forces experienced during acceleration and deceleration are distributed to avoid point loads. In a particular embodiment, the paddles are four feet wide.

Also, by closely spacing the inner surfaces of the paddles to the sides of the container, less relative speed is acquired before the container "bumps into" the trailing (or leading) paddles during trolley acceleration (or deceleration). In this manner, damage to the spreader, head block, or the container itself, is prevented.

FIG. 8F is an enlarged perspective view of an alternative embodiment of collector paddles. In FIG. 8F, collector "pads" are employed on the lower ends of the paddles. In particular, two pads 870, 872 are shown at the bottom ends of respective paddles 850, 852. Each pad is provided with respective sets of three braces 871, 873 on their outer surfaces, away from the container position, joining the pads to the outer surfaces of the paddles.

The pads are essentially braced extensions of the paddles' inner surfaces, flared outward away from the container. The pads provide additional guidance for the container as it is lifted into position between the paddles. By providing a bigger effective target into which the container is to be lifted, the pads ensure that the container does not collide with the sharp, unyielding ends of the paddles themselves. The pads are a precaution designed for when blowing wind induces sway in the container on its ascent, or in the event an anxious operator begins to move the trolley horizontally before the container is securely lifted into position between the paddles. The pads ensure that the container will be "funneled" into its proper position in the event it is not lifted straight vertically.

As a third important feature, the upper block 815 is provided with a set of four anti-lift rollers, two of which are illustrated as elements 818, 819. The anti-lift rollers contact the bottom surface of roller anti-lift flanges such as 803.

The principles and advantages of these features may be understood in greater detail, as follows.

During periods of trolley acceleration (or deceleration), a moment develops regarding the entire trolley (not just the container). This moment tends to move the center of gravity CG toward the trailing end (or leading end) of the trolley-container assembly. During periods of acceleration, this in turn tends lift the trailing end of the trolley upward, against the force of gravity, toward the girders. During periods of deceleration, the CG tends to move toward the leading end of the trolley, tending to lift the leading end upward.

The anti-lift rollers 818, 819 are blocked by anti-lift flanges 802, 803 to ensure that any forces tending to lift one end of the trolley are counteracted. In this manner, the trailing end of the trolley does not lift during periods of acceleration, and the leading end of the trolley does not lift during periods of deceleration as it might.

Also, as the trolley is accelerated or decelerated along the trolley girders, the container's inertia or momentum tends to force it against the inner surfaces of the collector paddles. This force, not only tending to make the end of the trolley rise, tends to damage the container or the trolley itself. However, the presence of the anti-lift flanges 802, 803 ensure that the anti-lift rollers 818, 819 prevent the trolley from experiencing motion-induced sway. At the same time, the broad inner surfaces of the collector paddles disperse the force of any contact with the container. Thus, advantageously, not only does the close positioning of long paddles to the container prevent the container from swaying, but the anti-lift rollers ensure that the trolley, considered as a whole, does not sway.

In operation, the trolley's spreader lifts the container from its source (initial) position upward, into its position between the collector paddles. As an optional feature, in combination with other features, the invention provides that the head block and spreader may be held tightly upward against the top of the trolley. Because bringing the head block and spreader tightly into contact with the trolley may consume time during the loading and unloading process, this may not be a desirable feature in all embodiments. The paddles alone provide substantial sway prevention, regardless of whether or not the head block and spreader are held tightly against the trolley.

In any event, the trolley as a whole may be subjected to magnitudes of acceleration and deceleration which could have caused unacceptable sway, or even physical damage, in conventional trolley arrangements. At the destination, the container is lowered, in a substantially vertical direction, to its destination position. By allowing such acceleration and deceleration, the time required for the invention to move the container from its source position to its destination position can be minimized.

Because the path travelled by the container is vertically upward to a secure position, then generally horizontally, then vertically downward, substantially less operator skill is required. In many known systems in which sway is experienced, the skill of the operator substantially affects the loading or unloading cycle time.

In addition to the features and advantages discussed above, the braces on the collector paddles ensure that the assembly is strong enough to handle the horizontal holding forces and moments which are encountered in the high acceleration and deceleration phases of operation. Less operator skill is required because the individual tasks required of the operator (vertically lifting, horizontally accelerating, vertically lowering) are simpler, and the overall task is simpler.

This operational simplicity also makes automation of the loading process much easier. Cranes involving automated (for example, computer-controlled) processes can more easily programmed and more safely operated, because the individual movement tasks are simpler and are in a predictable sequence.

In certain conventional systems, the container is not lifted to its highest vertical position, so that sway is allowed to develop. In contrast, the illustrated embodiment is operated by lifting a load to its highest position, held within its cove between the collector paddles, before horizontal motion begins. Optionally, the spreader and head block may be tightly held within the cove, to secure the container. This prevention or reduction of sway is achieved in a manner substantially different from known systems.

In the conventional trolley arrangement, the operator could attempt to reduce cycle time in loading or unloading a ship only by attempting to move the load horizontally before he was even finished moving it vertically. Thus, the conventional arrangement was prone not only to the shortcomings of the individual operator's skill, but the method suffered from the inherent drawback that, at the destination, the sway have to be counteracted in some way. This has often involved complex, costly, or slowly-acting anti-sway mechanisms.

In contrast, according to the present invention, the load is brought to its highest vertical position and held in place before any horizontal movement occurs. Then, the trolley can accelerate and decelerate at magnitudes which would be totally unacceptable in the conventional arrangement.

The conventional arrangement would be unable to cope with the violent swaying which would necessarily occur with this extreme acceleration and deceleration. Indeed, the acceleration and deceleration magnitudes of being routinely handled by the present invention would quickly cause physical damage to spreader arrangements of conventional systems.

Further, by providing the trolley assembly on girders which are vertically movable, the invention minimizes the distance which the container must be lifted. By thus lowering the girder to its lowest point, the time required to lift the container to the trolley is minimized. Thus, the container enters its maximum horizontal acceleration and deceleration phase as soon as possible.

Thus, by swiftly moving a container to its highest vertical position, then quickly accelerating and decelerating it to above its destination position, and swiftly lowering the container to the destination position, the invention reduces the cycle time in loading or unloading cargo containers.

Modifications and variations of the above-described embodiment of the present invention are possible, as will be appreciated by those skilled in the art in light of the above teachings. It therefore is to be understood that, within the scope of the appended claims and their equivalents, the invention may be practiced otherwise than as specifically described.

What is claimed is:

1. An arrangement for quickly moving a container from a source position to a destination position, the arrangement comprising:

a) at least one generally horizontal girder: and b) a trolley, arranged to move along the at least one girder without swaying with respect to the at least one girder as the trolley moves along the at least one girder, the trolley including:

1) at least a pair of opposed collector paddles which are integral or substantially rigidly connected with respect to the rest of the trolley so as not to sway with respect to the at least one girder as the trolley accelerates or decelerates, the paddles defining a collector space into which the container may fit, the collector paddles having a length great enough to extend below the center gravity of the container when the container is at its highest position in the space between the collector paddles, so as to counteract acceleration-induced or deceleration-induced moments acting on the container so as to substantially prevent sway of the container.

2. The arrangement of claim 1, wherein:

the trolley further includes at least one trolley anti-lift structure; and the girder further includes at least one girder anti-lift structure, disposed with respect to the at least trolley anti-lift structure to counteract any moments tending to lift an end of the trolley longitudinally along a path of the container so as to prevent substantially prevent acceleration-induced or deceleration-induced moments acting on the trolley so as to substantially prevent sway of the trolley.

3. The arrangement of claim 2, wherein:

the girder anti-lift structure includes at least one flange disposed longitudinally along the girder; and the trolley anti-lift structure includes at least one roller disposed beneath the girder's flange so that the at least one flange blocks the at least one roller from further upward movement when the moments act on the trolley to attempt to raise the at least one roller.

4. The arrangement of claim 1, wherein:

the container in its highest position between the paddles is not held tightly upward, but is substantially prevented from swaying by the collector paddles.

5. The arrangement of claim 1, further comprising:

means for holding the container up vertically, tightly in place.

6. The arrangement of claim 1, wherein at least one of the paddles includes:

a pad, extending downward from a lower edge of the paddle and at a non-zero angle with respect to an inner face of the paddle, to facilitate guiding of the container into the space between the collector paddles and to minimize collision of the container with the lower edge of the collector paddles.

7. The arrangement of claim 1, further comprising:

means for raising and lowering the at least one generally horizontal girder on which the trolley is arranged, so as to minimize a distance the container is lifted and lowered to and from the space between the collector paddles.

8. A trolley for transporting a container from a source position to a destination position, the trolley comprising:

a) a spreader adapted to receive the container;

b) means for raising and lowering the spreader and the container; and c) at least one pair of opposed collector paddles, extending downward to beneath the center of gravity of the container when the raising means has raised the container to between the pair of collector paddles, the collector paddles integral or substantially rigidly connected with a body of the trolley so that the paddles do not allow sway of the trolley or container as the trolley accelerates or decelerates.

9. The trolley of claim 8, further comprising:

anti-lift rollers, disposed at different points longitudinally along a path of the trolley, for ensuring that moments induced by acceleration or deceleration of the trolley do not induce sway of the trolley.

10. The trolley of claim 8, wherein at least one of the paddles includes:

a pad, extending downward from a lower edge of the paddle and at a non-zero angle with respect to an inner face of the paddle, to facilitate guiding of the container into the space between the collector paddles and to minimize collision of the container with the lower edge of the collector paddles.

11. A method for moving a container from a source position to a destination position, the method comprising the steps of:

lowering a spreader to grasp the container at the source location;

lifting the spreader and container to a position between at least one pair of opposed collector paddles which are offset from each other along a longitudinal path leading from the source location to the destination location, the collector paddles extending downward to a level below a center of gravity of the container so as to counteract acceleration-induced or deceleration-induced moments acting on the container so as to substantially prevent sway of the container during acceleration or deceleration;

accelerating the spreader, container, and collector paddles at a high rate of acceleration, the accelerating step beginning substantially after the lifting step has been completed;

decelerating the spreader, container, and collector paddles at a high rate of deceleration so as to arrive at a point substantially vertically above the destination location; and lowering the spreader and container so as to deposit the container at the destination location.

12. The method of claim 11, wherein the lifting step includes:

holding the spreader and container in place within a trolley which includes the collector paddles, so as to substantially prevent sway of the container during the accelerating and decelerating steps.

13. The method of claim 12, wherein the holding step does not include holding the spreader and container tightly in a vertical direction, so as to reduce strain on cables holding the container up, wherein the paddles substantially prevent sway of the container.

14. The method of claim 11, further comprising the step, before the lowering step, of:

lowering a generally horizontal girder on which a trolley having the spreader and collector paddles may move horizontally, so as to allow the lowering and lifting steps to be carried out over a smaller vertical distance.

* * * * *